US008016315B2

(12) United States Patent
Neiley et al.

(10) Patent No.: US 8,016,315 B2
(45) Date of Patent: Sep. 13, 2011

(54) MODULAR BINDING FOR SPORTS BOARD

(75) Inventors: Roger Neiley, Laguna Beach, CA (US); Anthony Scaturro, Laguna Niguel, CA (US)

(73) Assignee: Flow Sports, Inc., San Clemente, CA (US)

( * ) Notice: Subject to any disclaimer, the term of this patent is extended or adjusted under 35 U.S.C. 154(b) by 310 days.

(21) Appl. No.: 11/541,435

(22) Filed: Sep. 29, 2006

(65) Prior Publication Data

US 2007/0158929 A1 Jul. 12, 2007

Related U.S. Application Data

(60) Provisional application No. 60/722,664, filed on Sep. 30, 2005.

(51) Int. Cl.
*A63C 9/00* (2006.01)

(52) U.S. Cl. ..... 280/611; 280/617

(58) Field of Classification Search ..... 280/14.24, 280/619, 620, 623, 624, 633, 634, 842; 36/69, 36/89, 117.1
See application file for complete search history.

(56) References Cited

U.S. PATENT DOCUMENTS

| | | | | |
|---|---|---|---|---|
| 4,353,574 | A | 10/1982 | Faulin | |
| 4,660,303 | A | 4/1987 | Courvoisier et al. | |
| 4,719,670 | A | 1/1988 | Kurt | |
| 4,949,479 | A | 8/1990 | Ottieri | |
| 4,979,760 | A * | 12/1990 | Derrah | 280/607 |
| 5,090,138 | A * | 2/1992 | Borden | 36/102 |
| 5,150,537 | A | 9/1992 | Tacchetto et al. | |
| 5,556,123 | A | 9/1996 | Fournier | |
| 5,893,576 | A | 4/1999 | Hauglin | |
| 5,918,897 | A | 7/1999 | Hansen et al. | |
| 5,971,423 | A | 10/1999 | Hansen et al. | |
| 6,003,893 | A | 12/1999 | Hansen | |
| 6,065,770 | A | 5/2000 | Hansen et al. | |
| 6,116,634 | A | 9/2000 | Mometti | |
| 6,155,578 | A | 12/2000 | Patterson | |

(Continued)

FOREIGN PATENT DOCUMENTS

| | | |
|---|---|---|
| EP | 793920 | 9/1997 |

(Continued)

OTHER PUBLICATIONS

Derwent Accession No. 8325112 for European patent No. EP 793920.

*Primary Examiner* — Hau V Phan
*Assistant Examiner* — Bridget Avery
(74) *Attorney, Agent, or Firm* — Fred C. Hernandez; Mintz Levin Cohn Ferris Glovsky and Popeo PC

(57) ABSTRACT

Disclosed is a snowboard binding for coupling a snowboard boot to a snowboard. The binding includes a highback that extends upwardly from a midfoot or heel region of the binding to provide rear support for the boot. In one embodiment, the highback is formed of a plurality of modular components that each can be manufactured of a separate material to collectively provide desired structural characteristics to the highback. The attachment of the highback, its supporting elements and one or more straps to retain the boot within the binding are arranged such that certain attachment points are fixedly connected to each other and thus made to move synchronously when the position of the highback with respect to the binding's base is adjusted.

17 Claims, 14 Drawing Sheets

U.S. PATENT DOCUMENTS

| | | | | |
|---|---|---|---|---|
| 6,234,514 | B1 | 5/2001 | Dubuque | |
| 6,364,323 | B1 | 4/2002 | Coulter | |
| 6,416,074 | B1 | 7/2002 | Maravetz et al. | |
| 6,428,032 | B1 | 8/2002 | Humbel | |
| 6,543,793 | B1 * | 4/2003 | Reuss et al. | 280/11.36 |
| 6,910,706 | B2 | 6/2005 | Holzer | |
| 6,938,913 | B2 | 9/2005 | Elkington | |
| 7,063,346 | B2 | 6/2006 | Elkington | |
| 7,207,592 | B2 | 4/2007 | Pascal et al. | |
| 7,232,132 | B2 * | 6/2007 | Elkington | 280/11.32 |
| 7,232,147 | B2 * | 6/2007 | Couderc | 280/623 |
| 7,246,811 | B2 | 7/2007 | Martin | |
| 7,367,579 | B2 * | 5/2008 | Elkington | 280/611 |
| 2001/0015543 | A1 | 8/2001 | Joubert Des Ouches | |
| 2001/0052688 | A1 | 12/2001 | Carpenter et al. | |
| 2002/0190502 | A1 | 12/2002 | Naito et al. | |
| 2004/0169350 | A1 | 9/2004 | Elkington | |
| 2004/0227327 | A1 | 11/2004 | Elkington et al. | |
| 2005/0046150 | A1 | 3/2005 | Couderc | |
| 2005/0057009 | A1 | 3/2005 | Couderc | |
| 2005/0062260 | A1 | 3/2005 | Elkington et al. | |
| 2005/0167933 | A1 | 8/2005 | Couderc | |

FOREIGN PATENT DOCUMENTS

| | | |
|---|---|---|
| WO | 00/76337 | 12/2000 |

* cited by examiner

MODULAR BINDING FOR SPORTS BOARD

This application claims priority of co-pending U.S. Provisional Patent Application Ser. No. 60/722,664, filed Sep. 30, 2005. Priority of the aforementioned filing date is hereby claimed and the disclosure of the Provisional Patent Application is hereby incorporated by reference in its entirety.

BACKGROUND

The disclosure relates to a device for retaining a foot or boot on a sports apparatus. In particular, the disclosure relates to a binding for receiving and retaining a foot or boot onto a sports apparatus such as a sports board.

A typical sports board binding includes a base plate (also known as a chassis) to support the sole of a user's foot or boot. Some bindings include a rear support element, or highback, that is positioned at the rear of the binding for supporting the user's lower leg. A connection member (such as a linkage cable) connects to the base plate to the highback. The connection member limits rearward rotation of the rear support element. In this manner, the highback enables the transmission of sensory information and energy between the user and the binding such that the lower leg can transmit or receive forces during the operation of the sports apparatus.

Given that the highback transmits such sensory information to the user, it can be highly desirable for the highback to conform to particular aspects of the user's leg, such as leg geometry. The particular physical characteristics of a user, in particular, the user's size, weight, and shoe size can influence the transmission of such sensory information. In addition, it is desirable for the highback to conform to the user's particular preference and particular steering style, which also affects the transmission of sensory information. Otherwise, the transmission of sensory information may not always occur with the greatest efficiency or effectiveness.

In view of the foregoing, there is a need for sports board binding that can be particularly adapted to a user's geometry and riding style.

SUMMARY

Disclosed is a snowboard binding for coupling a snowboard boot to a snowboard. Although described herein in the context of a snowboard binding for use with a snowboard, it should be appreciated that the binding described herein can be used with other types of sports equipment. For example, the binding can be configured for use with boards used in snowboarding, snow skiing, water skiing, snowshoeing, roller skating, and other activities and sports.

In one aspect, there is disclosed a modular binding for coupling a boot to a sport board. The binding comprises a base plate and a highback connected to the base plate and adapted to provide support to a rear region of a boot. The highback comprises at least two modular components, each modular component comprising a separate material such that the modular components collectively provide a structural characteristic to the highback.

In another aspect, there is disclosed a device for retaining a foot or a boot on a sports apparatus, comprising: a base plate extending from a rear end to a front end; first and second upwardly-extending side members on opposite lateral sides of the base plate; an upwardly-extending rear support element coupled to the side members at a pair of primary coupling locations; a connection member extending between the side members and the rear support element, wherein opposite ends of the connection member are attached to the side members at secondary coupling locations, the connection member adapted to transfer loads between the rear support element and a portion of the binding; and at least one adjustment mechanism adapted to permit longitudinal adjustment of at least one of the primary coupling locations and one of the secondary coupling locations while maintaining the primary coupling location in a fixed position relative to the secondary coupling location. The adjustment mechanism includes an outer member on a first side of the first side member and an inner member on an opposite side of the first side member, the inner and outer members adapted to lock the first side member therebetween to thereby lock the position of the primary coupling location and secondary coupling location.

Other features and advantages should be apparent from the following description of various embodiments, which illustrate, by way of example, the principles of the disclosed devices and methods.

DETAILED DESCRIPTION

Figure 1:
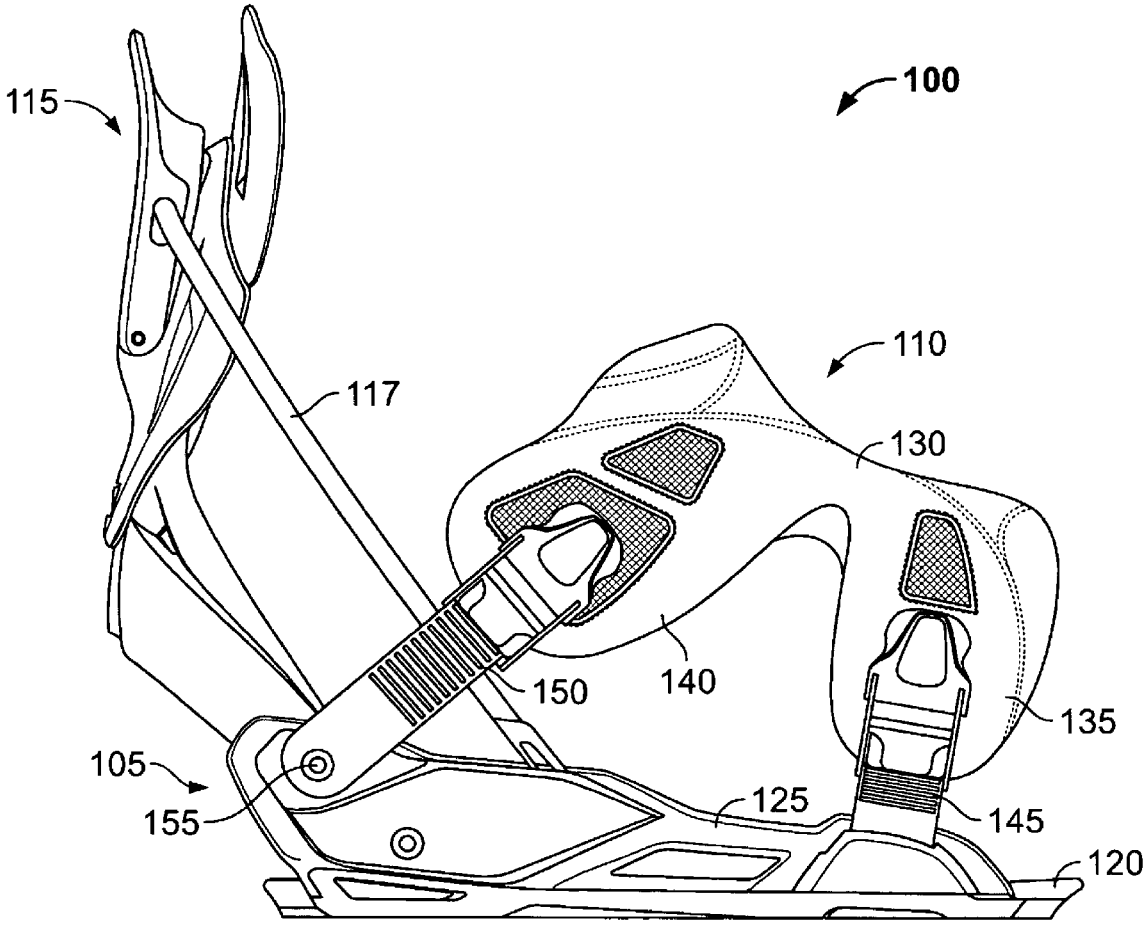
FIG. 1 shows a lateral side view of an exemplary embodiment of a snowboard binding.

Disclosed is a snowboard binding for coupling a snowboard boot to a snowboard. Although described herein in the context of a snowboard binding for use with a snowboard, it should be appreciated that the binding described herein can be used with other types of sports equipment. For example, the binding can be configured for use with boards used in snowboarding, snow skiing, water skiing, snowshoeing, roller skating, and other activities and sports.

The binding includes a highback that extends upwardly from a midfoot or heel region of the binding to provide rear support for the boot. In one embodiment, the highback is formed of a plurality of modular components that each can be manufactured of a separate material to collectively provide desired structural characteristics to the highback. In one embodiment, the highback is fixed in a predetermined though adjustable orientation, such as an upright position. In another embodiment, the highback can be moved between an upright and a reclined position to allow a means of entry into and/or exit from the binding.

On lateral and medial sides of the binding, the highback connects to a base plate (also known as a chassis) of the binding at a primary attachment location. Additionally, a connection member, such as a cable or linkage, connects to the highback at a first connection location and connects to the base plate at a pair of secondary attachment locations (opposite sides of the base plate) forward of the primary attachment location of the highback. The connection member provides load support between the highback and the base plate. The primary attachment location, first connection location, and secondary attachment location collectively form a triangular-shaped load distribution region for the binding. The three connection/attachment locations collectively function to provide structural support to the overall binding system, distribute loads and in turn support the user's body while the snowboard binding is in actual use. The particular geometry of the triangular-shaped load distribution region can be changed to vary the performance and feel of the binding during use, such as to vary the flexibility and rigidity of the highback.

Moreover, once the geometry of the triangular-shaped load distribution region is fixed, the position of the triangular-shaped load distribution region can be adjusted along multiple axes. In one embodiment, the triangular-shaped load distribution region can be adjusted only in the longitudinal (i.e., fore-aft) direction. In this regard, the binding includes an adjustment mechanism for varying the position of the triangular-shaped load distribution (and thus the position of the boot within the binding), while maintaining the preset geometry of the triangular-shaped load distribution region.

A user can configure the geometry of the triangle such that the binding provides a desired "feel" during use. For example, the user can individually adjust the positions of the first connection location and/or the primary and secondary attachment locations between the highback and the base plate. Another adjustment mechanism can then be used to adjust the position of the triangular-shaped load distribution region while maintaining the previously-selected geometry of the triangular-shaped load distribution region, as described in detail below.

FIG. 1 shows a lateral side view of a snowboard binding 100. The binding 100 generally includes a base plate 105, an instep member 110, and a heel member comprised of a highback 115 that extends upwardly from the base plate 105. A connection member 117 connects the highback 115 to the base plate 105, as described in detail below.

Figure 2:
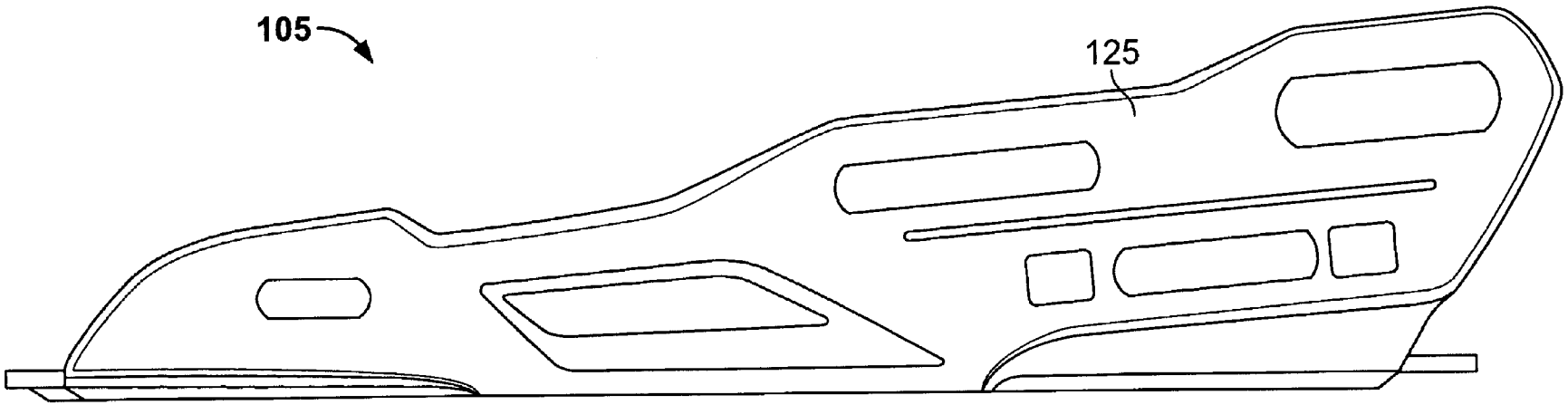
FIG. 2 shows a lateral side view of a base plate of the binding.
Figure 3:
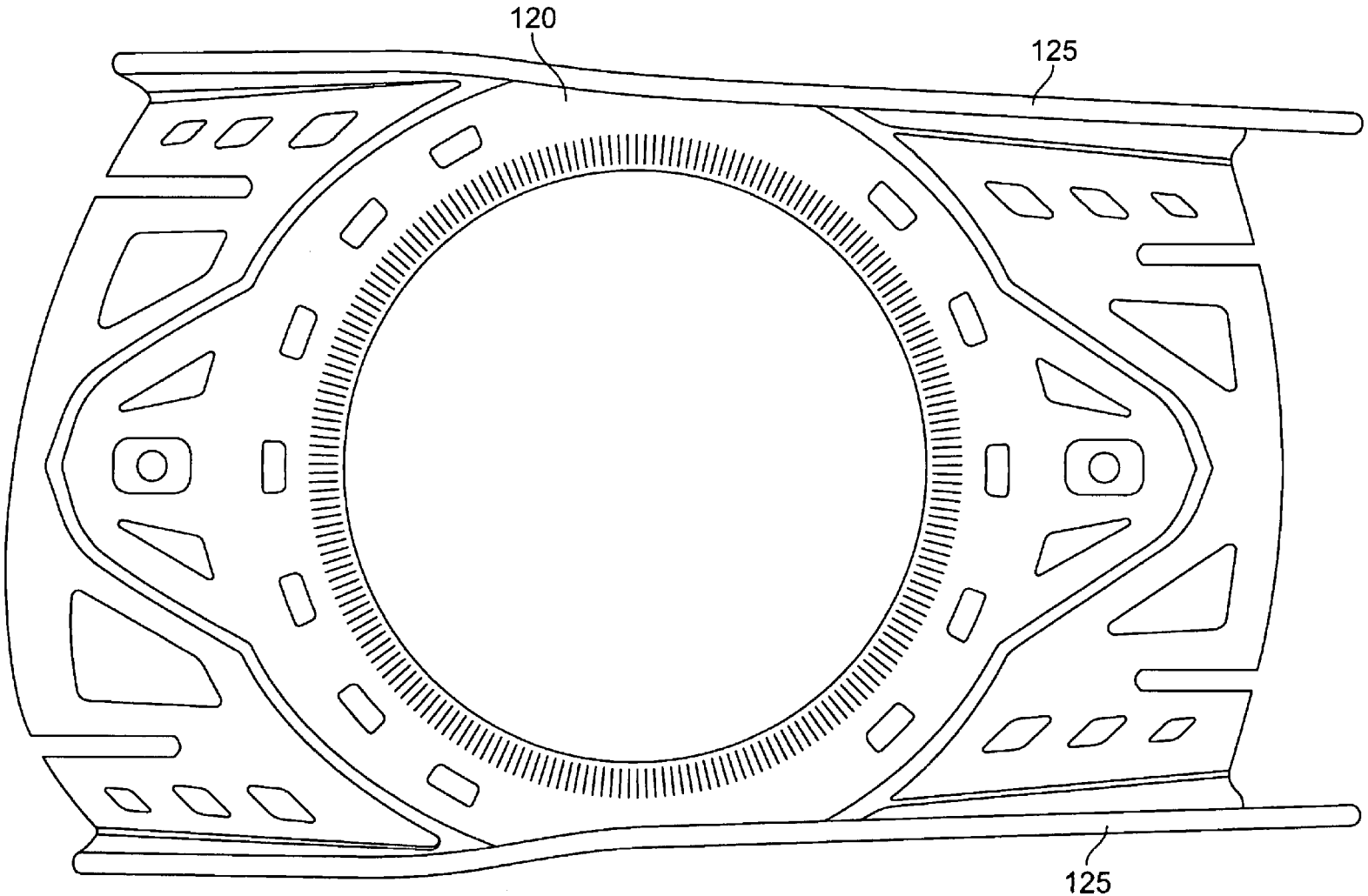
FIG. 3 shows a top view of the base plate.

FIG. 2 shows a lateral side view of the base plate 105 and FIG. 3 shows a top view of the base plate 105. The base plate 105 includes a base 120 having a size and shape that are configured to attach to the surface of a snowboard, such as, for example, using screws. The base 120 can have a plate-like configuration with a contour that complements a contour of an upper surface of the snowboard. The base plate 105 also includes a pair of side members 125 that are positioned on opposite lateral sides of the base 120. The side members 125 extend upwardly from the base 120 and are positioned on opposite sides of a snowboard boot when the boot is positioned in the binding 100.

With reference again to FIG. 1, the instep member 110 includes an instep support 130 that is sized and shaped to fit over the instep region of the snowboard boot. In this regard, the instep support 130 can be sized and shaped to conform to the instep region of the boot. For example, the instep support 130 can have a concave shape that fits around the instep region of the boot. In the exemplary embodiment shown in FIG. 1, the instep support 130 has an enlarged front region 135 and an enlarged rear region 140 interconnected by a smaller central region. It should be appreciated that the instep support 130 can have any of a variety of shapes that are configured to provide support to the instep or other regions of a boot, and may itself be adjustable fit various boot configurations and/or provide varying degrees of support and load transmission from the user to the snowboard.

In the embodiment shown in FIG. 1, the instep member 110 includes one or more attachment members, such as straps (including a front strap 145 and a rear strap 150), that connect one side of the instep support 130 to a side member 125. FIG. 1 shows only the lateral side of the binding 100. It should be appreciated that the opposite side (the medial side) includes a corresponding pair of straps that connect a side member 125 on the medial side of the binding 100. The front strap 145 connects at one end to the front region 135 of the instep support 130 and at an opposite end to a frontward region of the side member 125 of the base plate 105. The rear strap 150 connects at one end to the rear region 140 and at an opposite end to a rearward region of the side member 125. It should be appreciated that the binding may or may not be symmetrical about its longitudinal axis.

In one embodiment, the front strap 145 and/or the rear strap 150 includes a disengagement mechanism, such as, for example, a buckle, that permits one or both of the straps to disengage from the instep support 130. When disengaged from the straps 145 and 150, the instep support 130 can be moved aside to permit a user to move a snowboard boot downwardly into the binding 100. As mentioned, other straps are also located on the medial side of the binding 100 (opposite to the side shown in FIG. 1.) The straps on the medial side can also include disengagement mechanisms that permit the instep support 130 to be completely removed from the binding 100. Alternately, only the set of straps on one side of the binding 100 has a disengagement mechanism, such that the opposite set of straps retain the instep support 130 to the binding when one set is disengaged.

In another embodiment, the straps do not disengage from the instep support 130 so that the instep support 130 is fixed to the binding 100, such as described in the snowboard binding shown in U.S. Pat. No. 5,918,897, which is incorporated herein by reference in its entirety. Such a fixed instep support 130 is well suited for use in a snowboard binding where the highback 115 is configured to recline backward, as described below.

Whether or not the instep support 130 can be detached from the straps 145, 150, the binding 100 can include one or more adjustment mechanisms for adjusting the positioning of the instep member 110 relative to the base plate 105. For example, the straps 145 and 150 can have length adjustment mechanisms that permit the length of the straps 145 and 150 to be increased or decreased. This will permit the user to adjust the tightness of the instep support 130 on the boot, such as to achieve a tighter or looser fit. In one embodiment, the length adjustment mechanisms are buckle mechanisms.

The highback 115 is configured to provide support to a rear region of the boot when positioned in the binding 100. The highback 115 is attached to the base plate 105 at a primary attachment location 155. The position of the primary attachment location 155 can vary. In an exemplary embodiment, the primary attachment location 155 is located at or near the rear portion of the highback. The highback 115 is attached to both side members 125 on the base plate, although only one of the primary attachments locations 155 is shown in FIG. 1. The primary attachment location 155 between the highback 115 and the base plate 105 is also an attachment location for the rear strap 150 in the embodiment of FIG. 1, although it should be appreciated that the highback 115 and the rear strap 150 can be attached to the base plate 105 at different locations.

Figure 4:
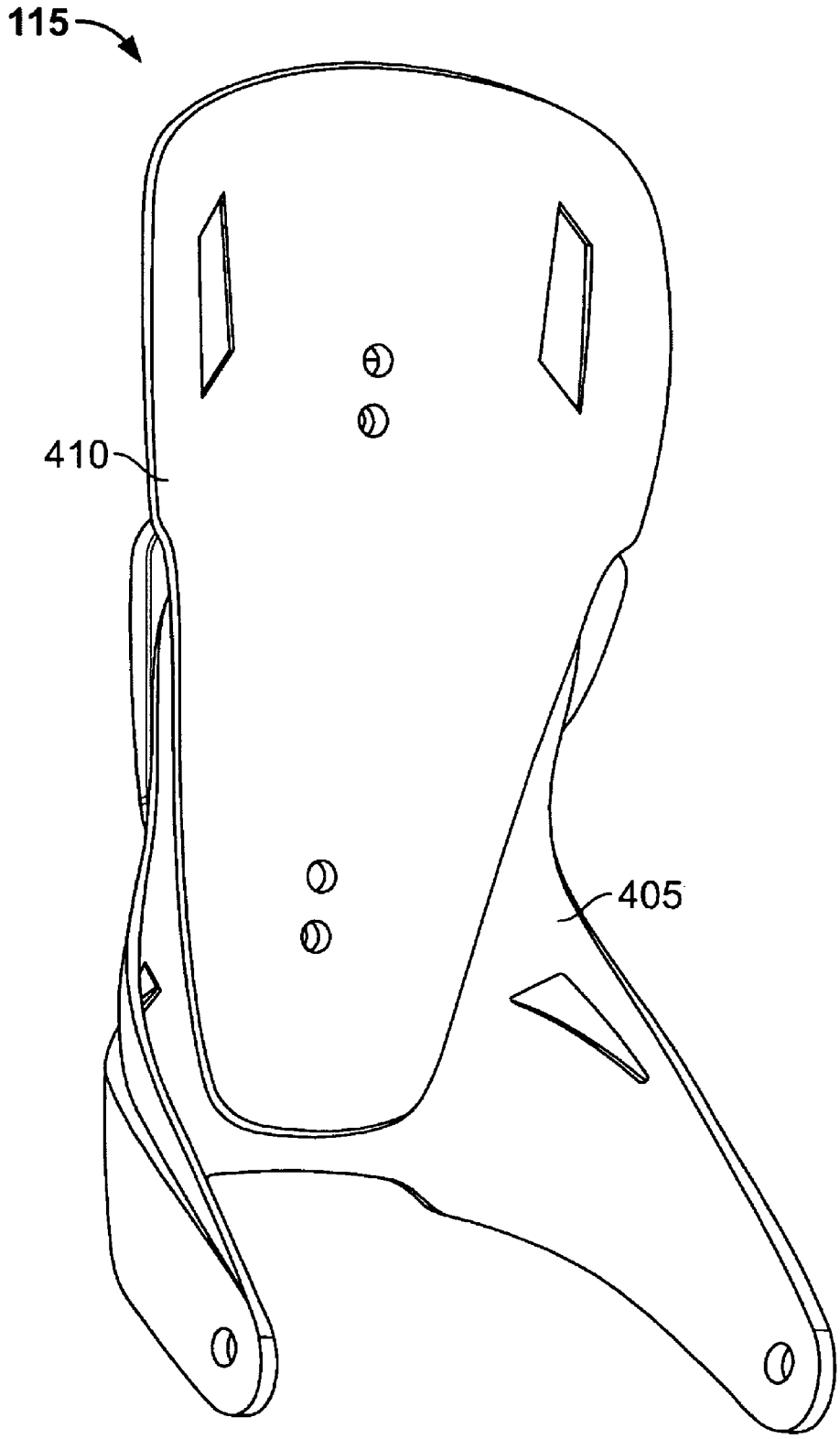
FIGS. 4 and 5 show front and rear views, respectively, of a modular highback.
Figure 5:
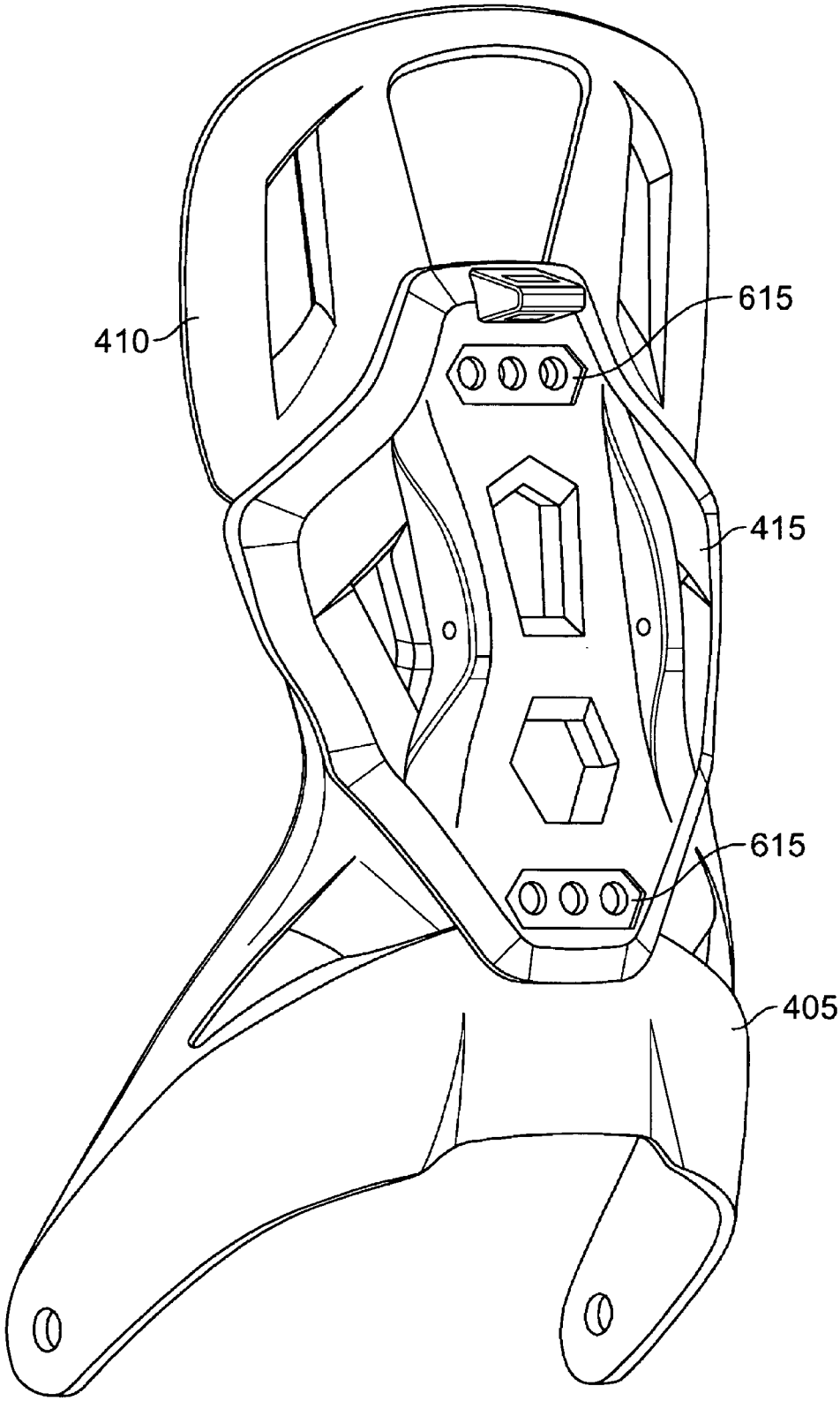

In one embodiment, the highback 115 is formed from a single piece of material. In another embodiment, the highback 115 is modularly formed by two or more separate components that couple to one another. FIGS. 4 and 5 show front and rear views, respectively, of a modular highback 115 that is formed from three separate components, including a lower component 405, an upper component 410, and a central component 415 (shown in FIG. 5).

The components 405, 410, and 415 are configured to be attached to one another to form the highback 115. When attached, the position of one or more of the components can be movably adjusted relative to the position of one or more of the other components. This permits the size and shape of the highback 115 to be adjusted by a user. For example, the upper component 410 can be configured such that it can be adjustably moved upward and downward and/or side-to-side or adjustably moved in a rotational manner. The other components can also be configured to move relative to one another and to also rotate relative to one another.

In one embodiment, one or more portions of the highback are allowed a certain range of motion to follow the boot's articulation during use. A spring or biasing mechanism may be incorporated into the system to allow automatic return of the highback's movable portion to a default position when load is removed.

Moreover, each of the components can each be manufactured of a material with specific material properties that are selected to provide the particular component with desired structural characteristics. For example, the lower component 405 can be manufactured from a material that is very rigid so that the lower component 405 provides primary structural support for the highback 115, while the central component 415 is manufactured of a material that is strong enough to withstand loads experienced during use, but that is lighter than the material of the lower component 405. Different materials can be used to manufacture the individual components to provide each component with desired structural properties and to collectively provide the highback 115 with desired structural characteristics. Some materials may be semi-solid or heat moldable in nature to allow portions of the binding to better confirm to individual boot shapes and pressure patterns.

In one embodiment, the lower component 405 that attaches to the base plate 105 is manufactured from forged aluminum alloy, the central component 415 is manufactured of injected plastic, and the upper component 410 is manufactured of injected plastic, but with a lower flex modulus than the material of the central component 415. Any portion of the highback that bears against the user's leg or boot can be faced with a compliant material to provide cushioning against the leg. It should be appreciated that the highback components can be manufactured from different materials than those described herein.

Figure 6:
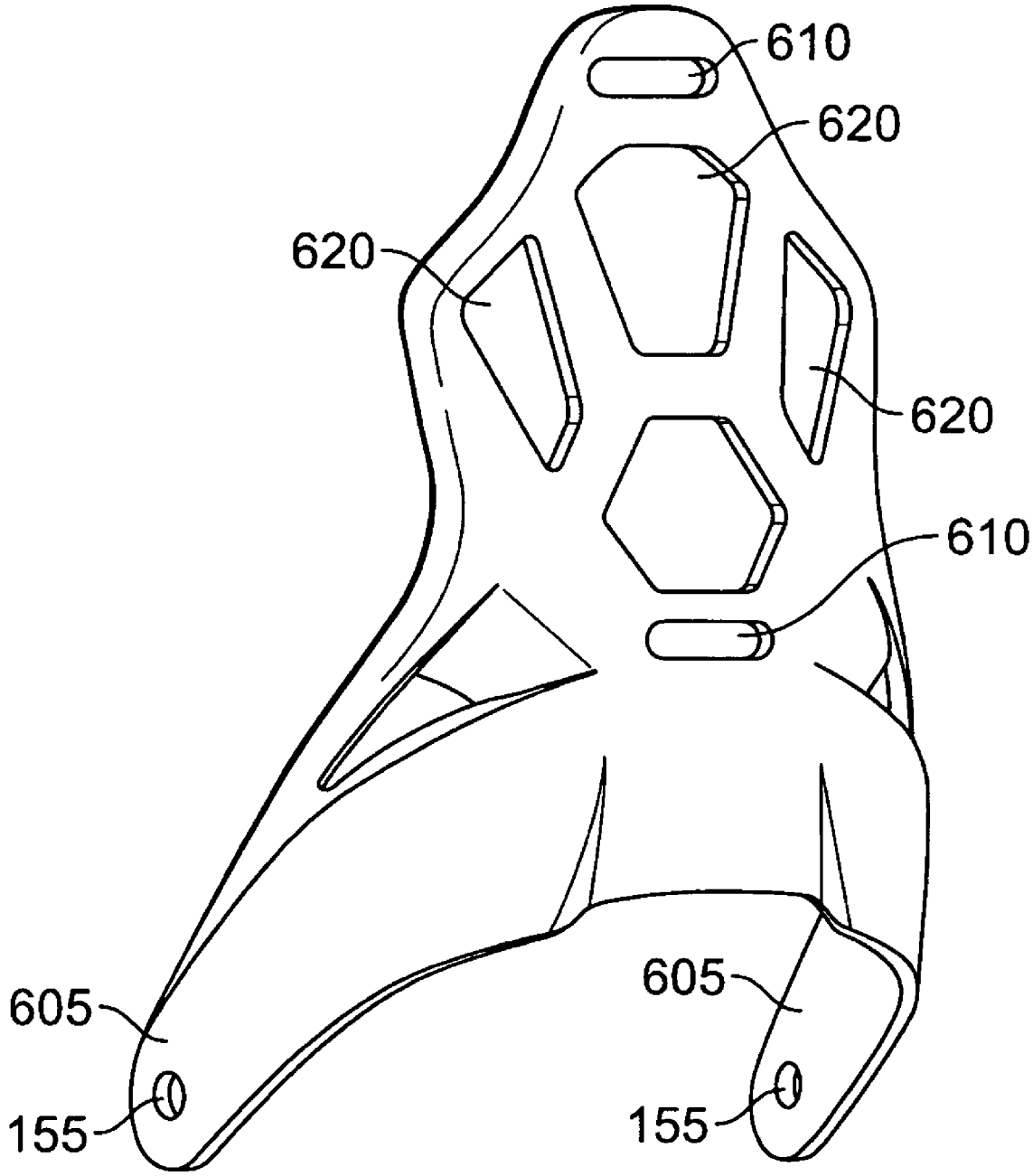
FIG. 6 shows a rear, perspective view of a lower component of the modular highback.

FIG. 6 shows a rear, perspective view of the lower component 405. The lower component 405 has an arched shape that is selected to complement the rear region of a snowboard boot. The attachment locations 155 (which attach the highback 115 to the base plate 105) can be located at or near the lower end of the lower component 405, such as at the tip of a pair of extensions 605 positioned on opposite lateral sides of the lower component 405. The lower component 405 (as well as the other components) can include any of a variety of apertures that facilitate attachment to the other components. For example, the lower component 405 includes a pair of slots 610 that can be aligned with a corresponding set of holes 615 (shown in FIG. 5) in the central component 415, as described below. The lower component 405 can also include alignment apertures 620 that are sized, shaped, and positioned to receive complementary shaped, outwardly extending protrusions 625 (shown in FIG. 7) on the central member.

Figure 7:
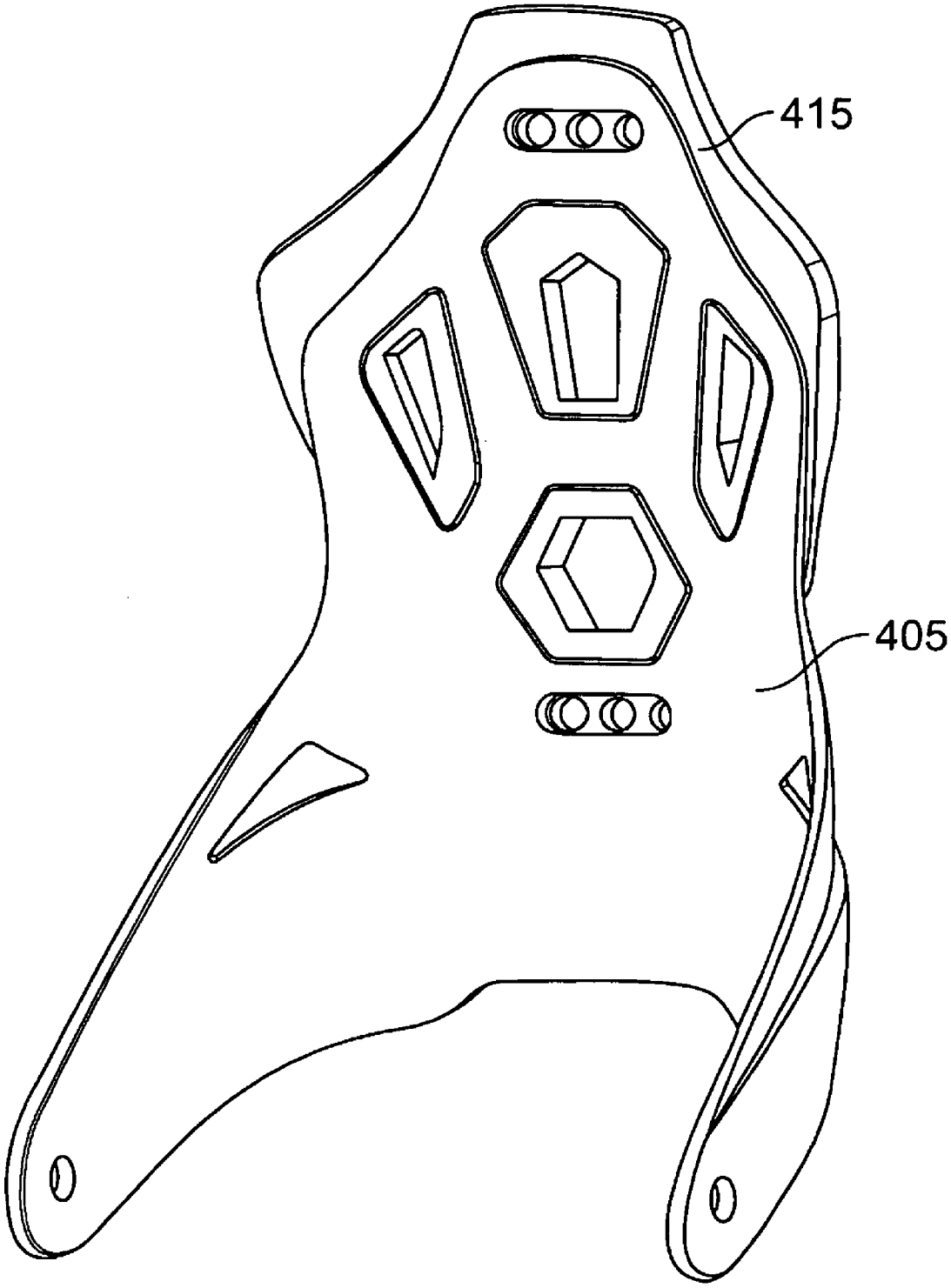
FIG. 7 shows a front, perspective view of the lower component coupled to a central component of the modular highback.

This is described in more detail with reference to FIG. 7, which shows a front, perspective view of the lower component 405 coupled to the central component 415. The slots 610 of the lower component 405 are aligned with the holes 615 of the central component 415. In addition, the outward protrusions 625 are aligned with and positioned within the alignment apertures 620 in the lower component 405. It should be appreciated that other alignment and attachment means can be used to align and attach the components of the highback 115 to one another. Moreover, the modular highback 115 is not necessarily limited to having three components, but can rather include any quantity of components that suit particular functional and structural requirements.

Figure 7B:
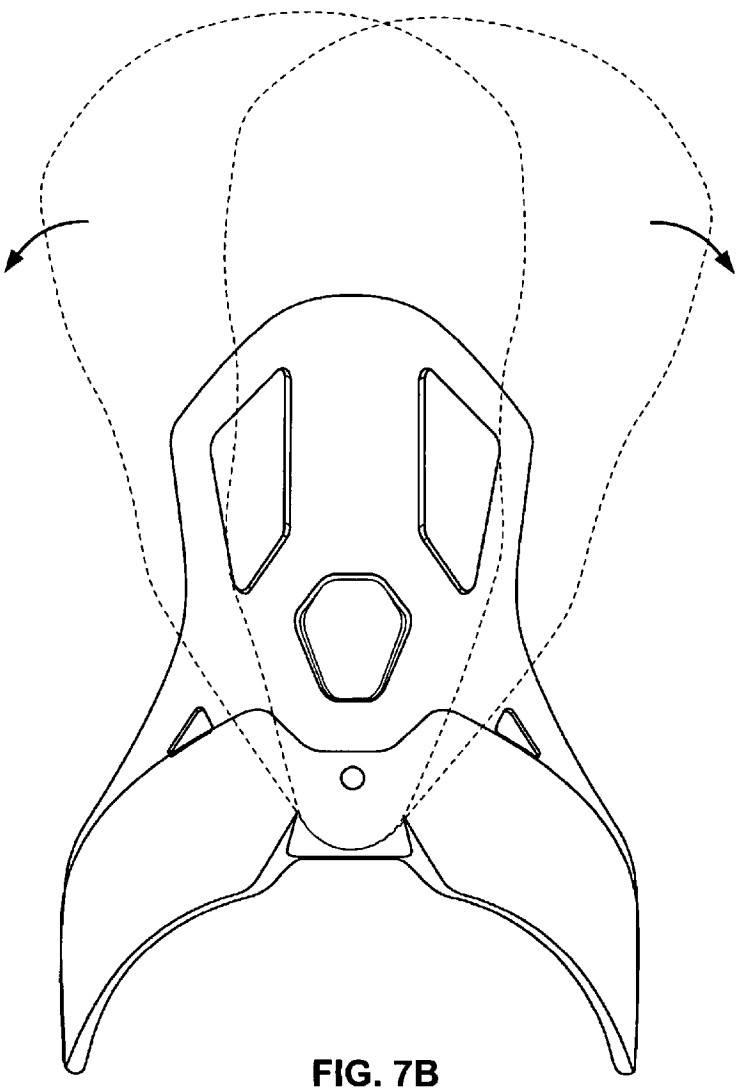
FIGS. 7A and 7B show another embodiment of a modular highback.
Figure 7A:
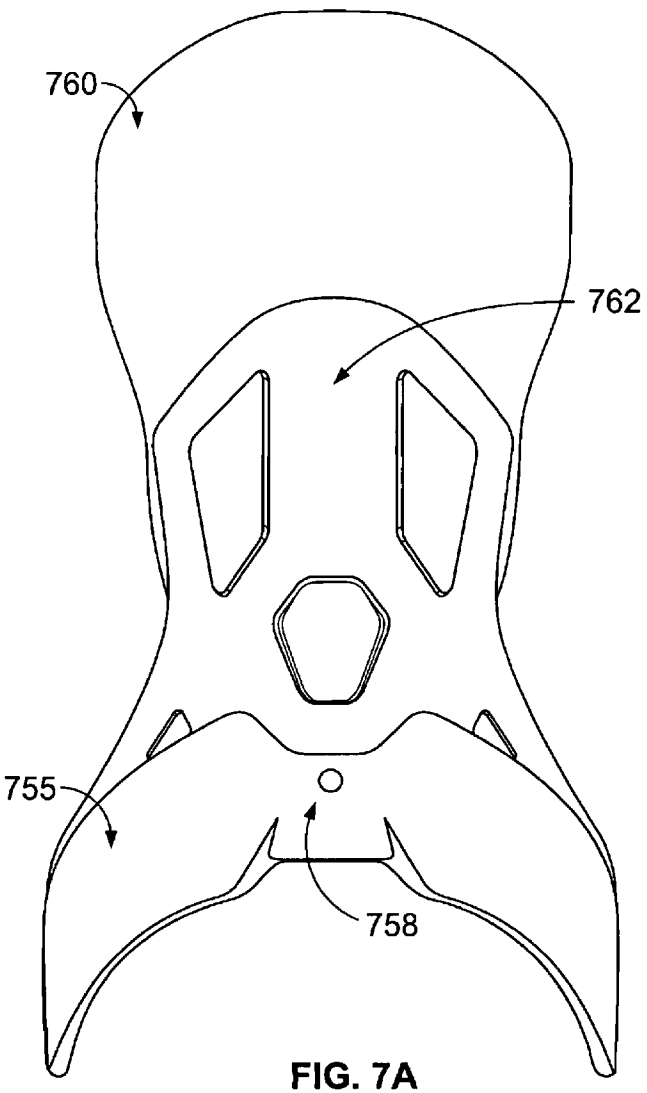

FIGS. 7A and 7B show another embodiment of a modular highback 115. The highback 115 includes a lower component 755 and an upper component 760 that are movably attached to one another via a pivotable or slideable attachment point 758. The lower component attaches to the base plate of the binding. The upper component 760 comprises a support panel that provides support to the user's leg during use. As represented by the dashed outlines in FIG. 7B, the upper component 760 can articulate or move relative to the lower component within a predetermined range of movement. Thus, the upper component 760 is allowed a certain range of motion to follow the boot's articulation. A spring or friction mechanism can be incorporated into the highback (such as at a location 762 between the upper and lower components) to bias the upper component toward a default orientation relative to the lower component and encourage automatic return of the highback's movable portion to the default position when load is removed.

Figure 7C:
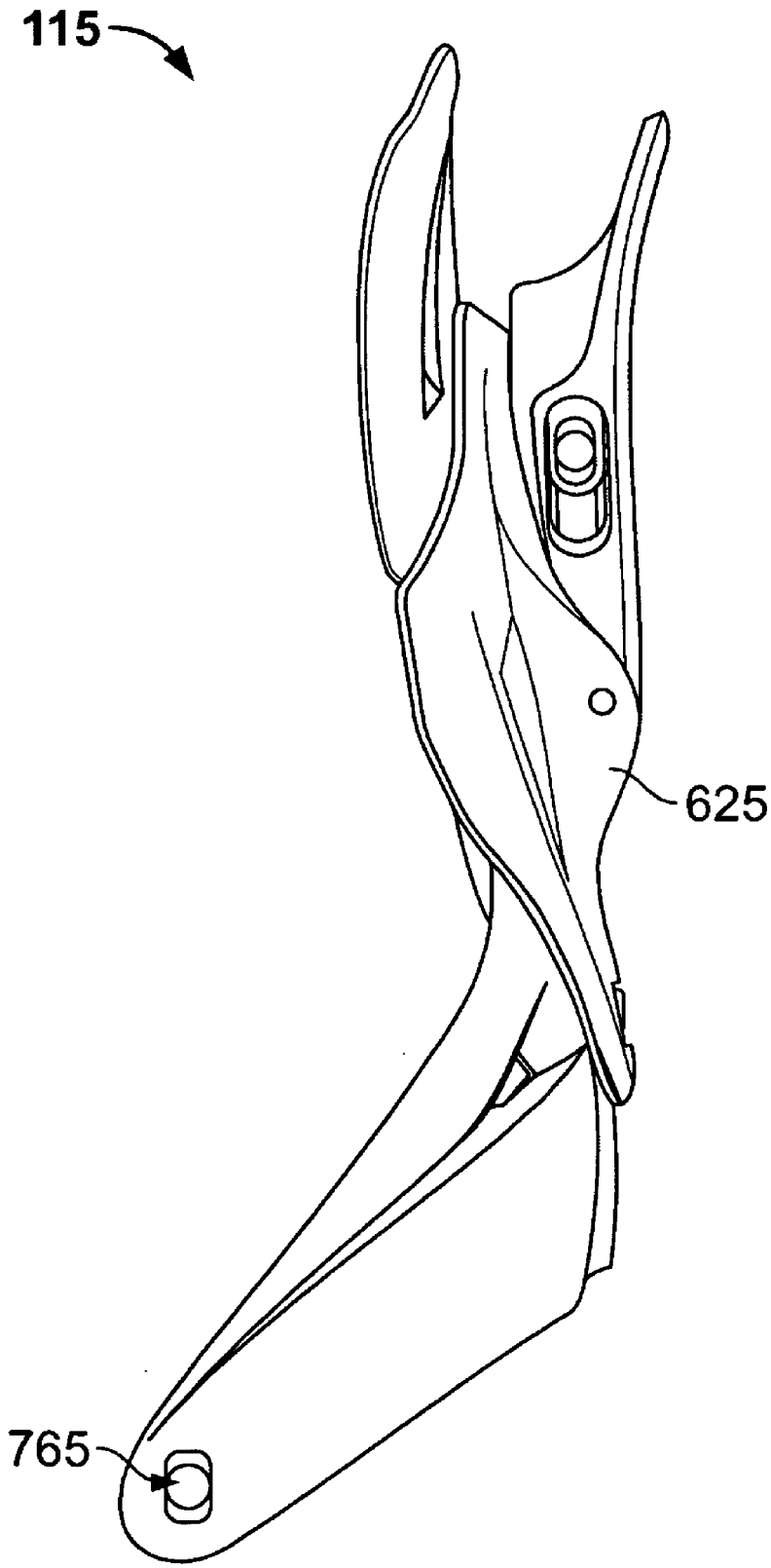
FIG. 7C shows another embodiment of the modular highback.

FIG. 7C shows another embodiment of the modular highback 115. The highback includes an attachment location comprised of an elongated hole 765. A corresponding attachment location is on the opposite side of the highback. The attachment location serves as a point of attachment between the highback 115 and the base plate. An insert, such as a bushing, comprised of a compressible material is positioned at or in the hole 765 to allow for defined movement of the highback. The bushing is a resiliently deformable bushing and is positioned at coupling points between modular components. The bushing can resiliently deform to allow a predetermined range of motion of one modular component with respect to another.

Any embodiment of the highback 115 can be fixed in the upright position shown in FIG. 1. A user's boot can enter the binding by disengaging the instep support 130 from the straps 145, 150 and moving the instep support to one side. The boot is then lowered downwardly onto the binding. Once the boot is in place, the instep support 130 is moved over the boot and re-engaged with the straps.

In another embodiment, the highback 115 is movable between the upright position (as shown in FIG. 1) and a reclined position wherein the highback has rotated downward, such as along the direction of the arrow A in FIG. 1. The highback 115 rotates about a predetermined location, such as about the attachment location 155. When the highback is in the reclined position, the user can slide the boot forwardly into the instep support 130. Once the boot is in place, the highback 115 is returned to the upright position and locked in place to secure the boot within the binding.

When in the upright position, the highback 115 provides support to the boot when the boot is positioned in the binding. With reference to the side view of the binding shown in FIG. 8, the upright position of the highback is at least partially supported by the connection member 117. A first end of the connection member 117 connects to the base plate at the secondary attachment location 820. The connection member 117 wraps around, or is connected to, the highback so that it contacts the highback at the first connection location 815. A second end of the connection member 117 then connects to a corresponding secondary attachment location 820 of the base plate.

Thus, the connection member 117 is connected to the highback 115 at the first connection location 815 and is connected to the base plate 105 at a secondary attachment location 820. It should be appreciated that the secondary attachment location 820 between the connection member 117 and the base plate 105 is obscured in FIG. 8 by an adjustment member, as described below. Notwithstanding the obscured view in FIG. 8, the connection member 117 is connected directly to the base plate 105.

The connection member 117 can be manufactured of any of a variety of materials that are configured to withstand the forces experienced by the connection member 117. Some exemplary materials are a stainless steel cable or a fiber based rope. The connection member 117 can also be a rigid rod. Moreover, a variety of different mechanisms and/or materials can be used to permit adjustment of the effective length of the connection member 117. For example, adjustment mechanisms can be positioned at the secondary attachment location 820 to vary the length at the termination location of the connection member 117. The connection member 117 can also include an internal length adjustment member that permits the axial length of the connection member 117 to be adjusted. The connection member can also be manufactured of a fibrous material that stretches and shrinks to a lockable length. Repositioning the attachment point of the connection member with respect to either the highback or the base plate also effectively changes its length and thus the forward lean of the highback. Other mechanisms and materials can also be used.

Figure 8:
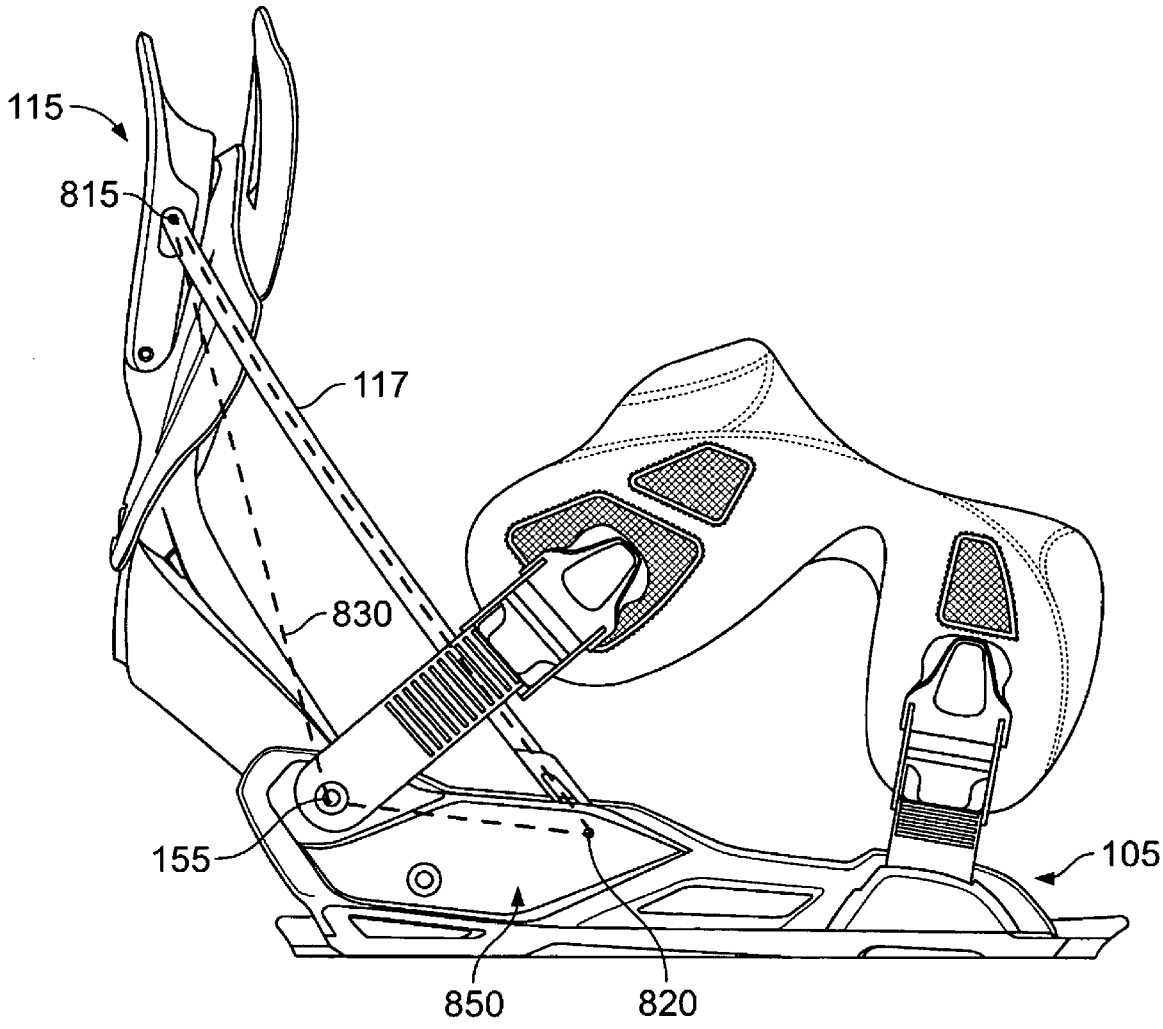
FIG. 8 shows another lateral side view of the binding.

With reference still to FIG. 8, the first connection location 815, the secondary attachment location 820, and the primary attachment location 155 (between the highback and the base plate 105) collectively define a triangular-shaped load distribution region or triangle 830 for the binding 100. The three attachment/connection locations collectively function to distribute loads that are experienced when the snowboard binding is in actual use. Rather than positioning the highback as a cantilevered element such as commonly done with other bindings, the triangular arrangement forms a structural support member that is inherently rigid and thus able to withstand the dynamic forces of riding with less structural mass than conventional systems.

The particular geometry of the triangle 830 can be changed to vary the performance and feel of the binding during use, such as to vary the flexibility and rigidity of the highback 115. For example, the first connection location 815 between the connection member 117 and the highback can be positioned higher or lower on the highback 115. In one embodiment, the position of the first connection location 815 is fixed. In another embodiment, the position of the first connection location 815 is movable. The secondary attachment location 820 and the primary attachment location 155 can also be fixed or movable.

In any event, a user can select a particular geometry for the triangle 830 that provides a desired feel for the binding during use, such as in terms of stiffness, flexibility, lower leg support, etc. A user can adjust the geometry of the triangle 830 by individually adjusting the locations of the attachment location 155, the connection location 815, and/or the connection location 820.

It can be appreciated that a user might desire to adjust the length of the binding to fit a particular boot, while still maintaining the previously-selected geometry of the triangle 830. This is desirable to achieve a particular position of the boot on the snowboard or the position of the boot with respect to various supporting components of the binding. Once the geometry of the triangle has been set, the position of the triangle 830 (and hence the position of the boot on the binding) can advantageously be adjusted while automatically retaining the geometry of the triangle 830. This permits the user to adjust the position of the triangle 830 without varying the geometry of the triangle 830. An exemplary mechanism for adjusting the position of the triangle 830 while maintaining the triangle geometry is now described.

With reference to FIG. 8, an adjustment member 850 is located on the lateral side of the base plate 105. Although not shown in FIG. 8, a similar adjustment member is located on the medial side of the base plate 105. The adjustment member 850 includes an outer housing and an inner housing that are movably disposed on the base plate 105 with the side member 125 of the base plate positioned therebetween, as described in more detail below with reference to FIG. 9. The adjustment member 850 maintains the primary attachment location 155 and the secondary attachment location 820 in a fixed distance with respect to one another.

The adjustment member 850 can be moved, such as in a sliding manner, generally along a longitudinal axis of the binding, while maintaining the fixed spatial relationship between the attachment location 155 and the second connection location 820. In one embodiment, the adjustment member 850 can also be moved along a vertical axis, such that movement of the adjustment member 850 and the triangle 830 is along both a vertical and a horizontal axis. During movement of the adjustment member 850, the first connection location 815 is also maintained in a fixed spatial relationship with the primary attachment location 155 and the secondary attachment location 820 such that the geometry of the triangle 830 remains fixed. In this manner, the adjustment member 850 permits adjustment of the horizontal and vertical positions of the triangle 830 while maintaining the previously-determined geometry of the triangle 830.

Figure 9:
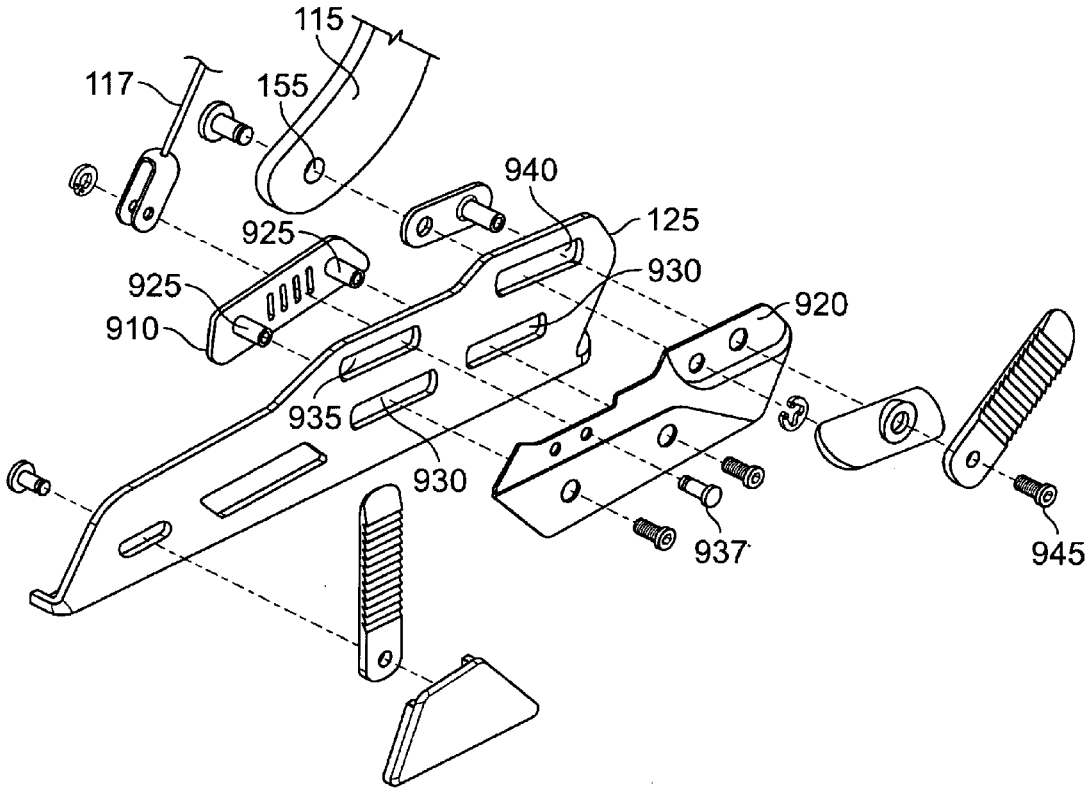
FIG. 9 shows an exploded view of a portion of an adjustment member of the binding.
Figure 9A:
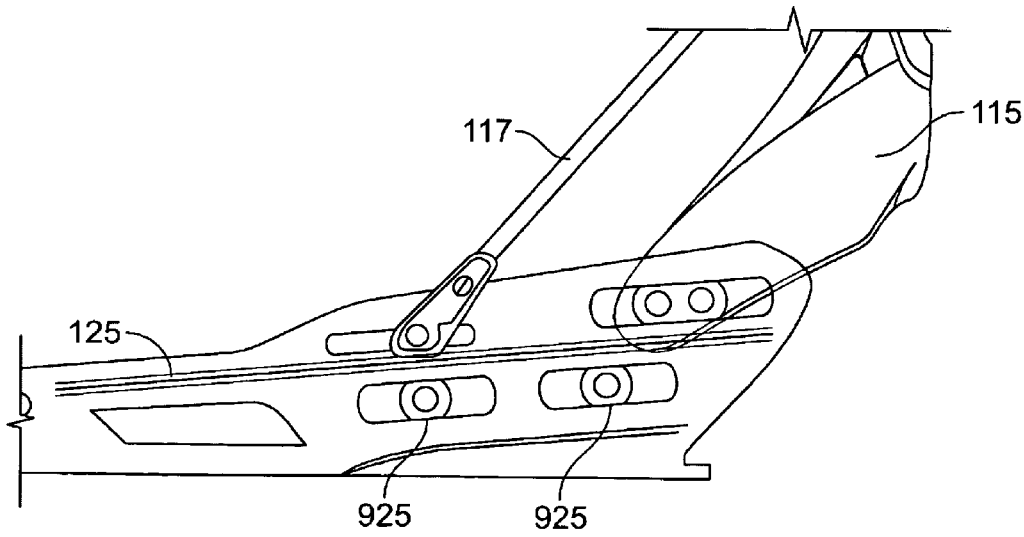
FIG. 9A shows a partially assembled, side view of the adjustment member coupled to the base plate.

FIG. 9 shows an exploded view of a portion of the adjustment member 850 of the binding 100. FIG. 9A shows a partially assembled, side view of the adjustment member coupled to the base plate. As mentioned, the adjustment member 850 includes an inner housing 910 and an outer housing 920 that are connected to one another with the side member 125 of the base plate 105 sandwiched therebetween. The inner housing 910 includes a pair of extensions 925 that are positioned through a corresponding pair of slots 930 in the side member 125. The extensions 925 connect to the outer housing 920. The slots 930 provide a guide for the extensions and the attached inner and outer housings to slide along the length of the binding 100.

Another slot 935 is located in the base plate 105. An attachment device 937, such as a screw, extends through the slot 935 and provides an attachment for the end of the connection member 117. The attachment device 937 fixedly attaches the end of the connection member 117 to the inner and outer housings 910 and 920. In this manner, the attachment device 937 defines the secondary attachment location 820 for the connection member 117.

The base plate 105 also includes yet another slot 940 for coupling to the primary attachment location 155 on the highback 115. An attachment device 945, such as a screw, extends through the slot 940 and provides an attachment for the highback 115 to the base plate 105 and the inner and outer housings of the adjustment member 850. In this manner, the attachment device 945 defines the primary attachment location 820 for the highback 115.

When assembled, the inner and outer housings of the adjustment member 850 provide attachments between (1) the connection member 117 and the base plate 105 and (2) the highback 115 and the base plate 105, while maintaining a fixed distance between the secondary attachment location 820 and the primary attachment location 155. When the adjustment member 850 is slid along the base plate (via the slots 930), the secondary attachment location 820 and the primary attachment location 155 also slide along the base plate while maintaining a fixed spatial relationship therebetween. As the adjustment member 850 slides, the entire highback 115 also slides due to the attachment of the highback 115 to the adjustment member 850 at the primary attachment location 155. In this manner, the geometry of the triangle 830 is fixedly maintained while the length of the binding is adjusted.

It should be appreciated that the configuration of the adjustment member 850 can vary. For example, the adjustment member 850 can have a unitary housing rather than inner and outer housings. Moreover, a single adjustment member 850 that interconnects across the lateral and medial sides of the base plate can be used to adjust the position of the triangle 830 rather than a pair of separate adjustment members 850 on the lateral and medial sides of the binding.

Figure 10:
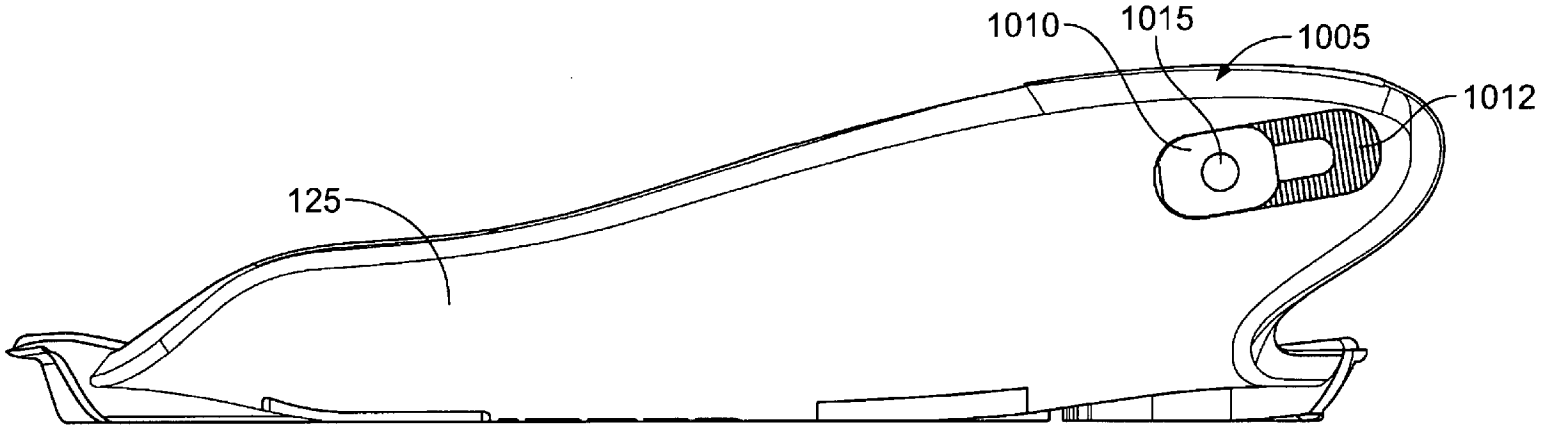
FIG. 10 shows a lateral side view of a portion of a binding that includes an alternative embodiment of an adjustment member.
Figure 11:
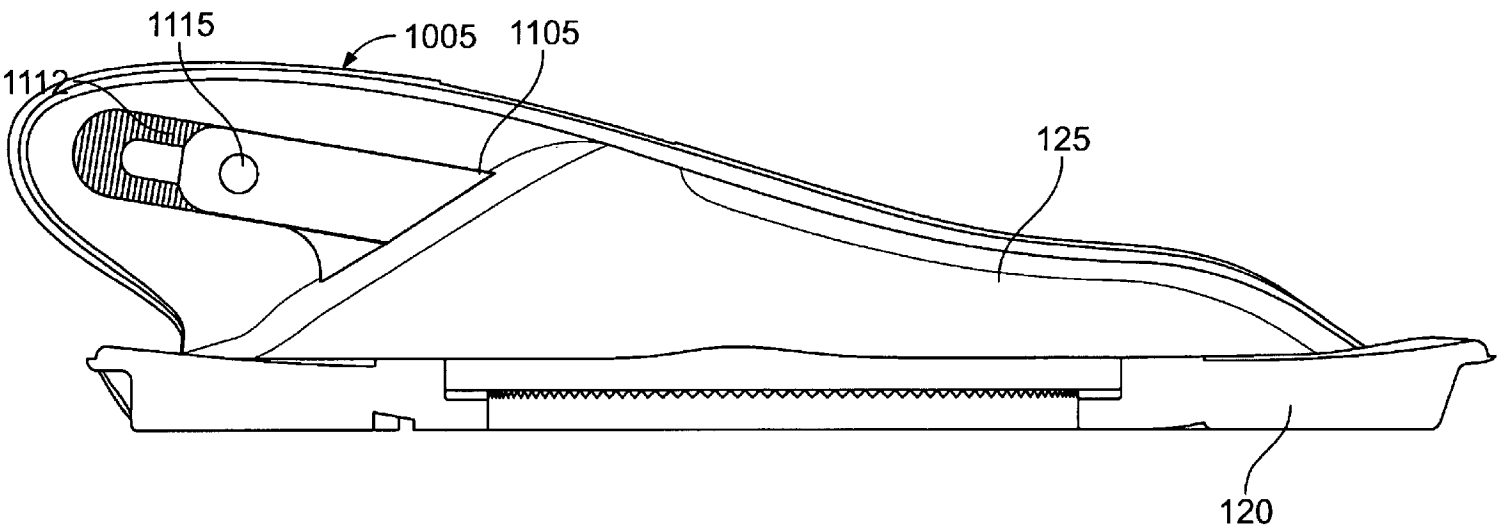
FIG. 11 shows a medial side view of the binding of FIG. 10.

FIG. 10 shows a lateral side view of a portion of a binding that includes an alternative embodiment of an adjustment member. FIG. 11 shows a medial side view of the binding of FIG. 10. For clarity of illustration, the highback is not shown in the binding of FIGS. 10 and 11. The binding includes a pair of side members 125 that are positioned on opposite lateral sides of the base 120. The side members 125 extend upwardly from the base 120 and are positioned on opposite sides of a snowboard boot when the boot is positioned in the binding 100.

With reference to FIGS. 10 and 11, the binding includes an adjustment and locking mechanism 1005 that permits longitudinal adjustment of the triangle 830. As best shown in FIG. 10, the adjustment mechanism includes an outer member 1010 that is slidably positioned on an outer side of the side member 125. The outer member can have teeth that mate with complimentary-shaped teeth 1012 on the side member 125. The outer member includes a hole 1015.

As best shown in FIG. 11, the adjustment mechanism also includes an inner member 1105 that is slidably mounted on or near a second side of the side member 125 opposite the outer member 1010. The outer member can have teeth that mate with complimentary-shaped teeth 1112 on the side member 125. The inner member 1105 includes a hole 1115 that aligns with the hole 1015 (FIG. 10) of the outer member 1010. A lock screw can be inserted into the holes 1015 and 1115 to lock the inner and outer members together so that they can both slide in conjunction with one another relative to the side member 125. The lock screw can include threads that mate with corresponding threads inside the hole 1015 and/or the hole 1115 to allow the lock screw to be tightened. The lock screw can be tightened to move the inner and outer members toward one another and lock the side member therebetween in a sandwich fashion. In this manner, the positions of the inner and outer members can be locked relative to the side member 125.

Figure 12:
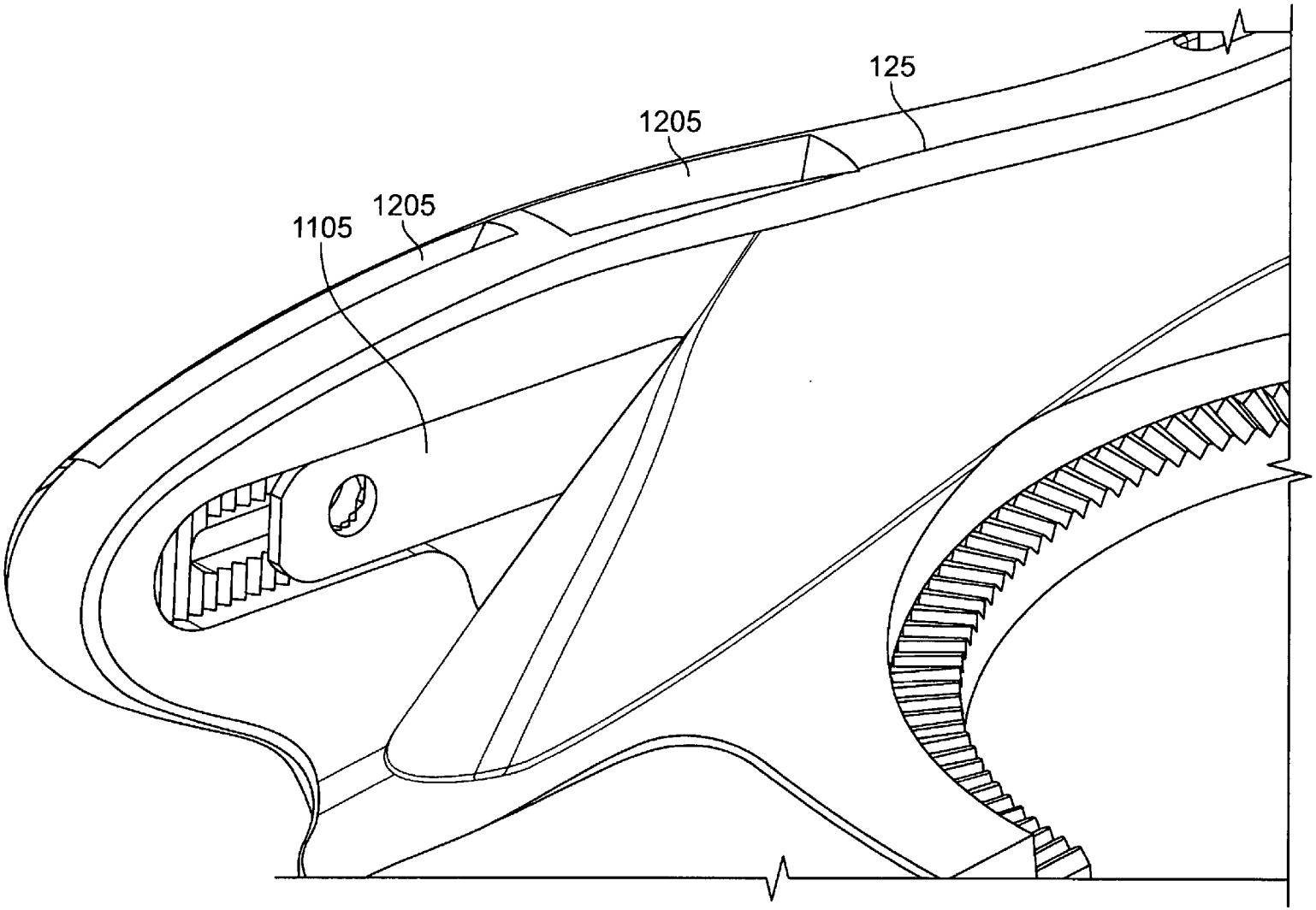
FIG. 12 shows a perspective view of an inner member positioned in the side member of the binding.
Figure 13:
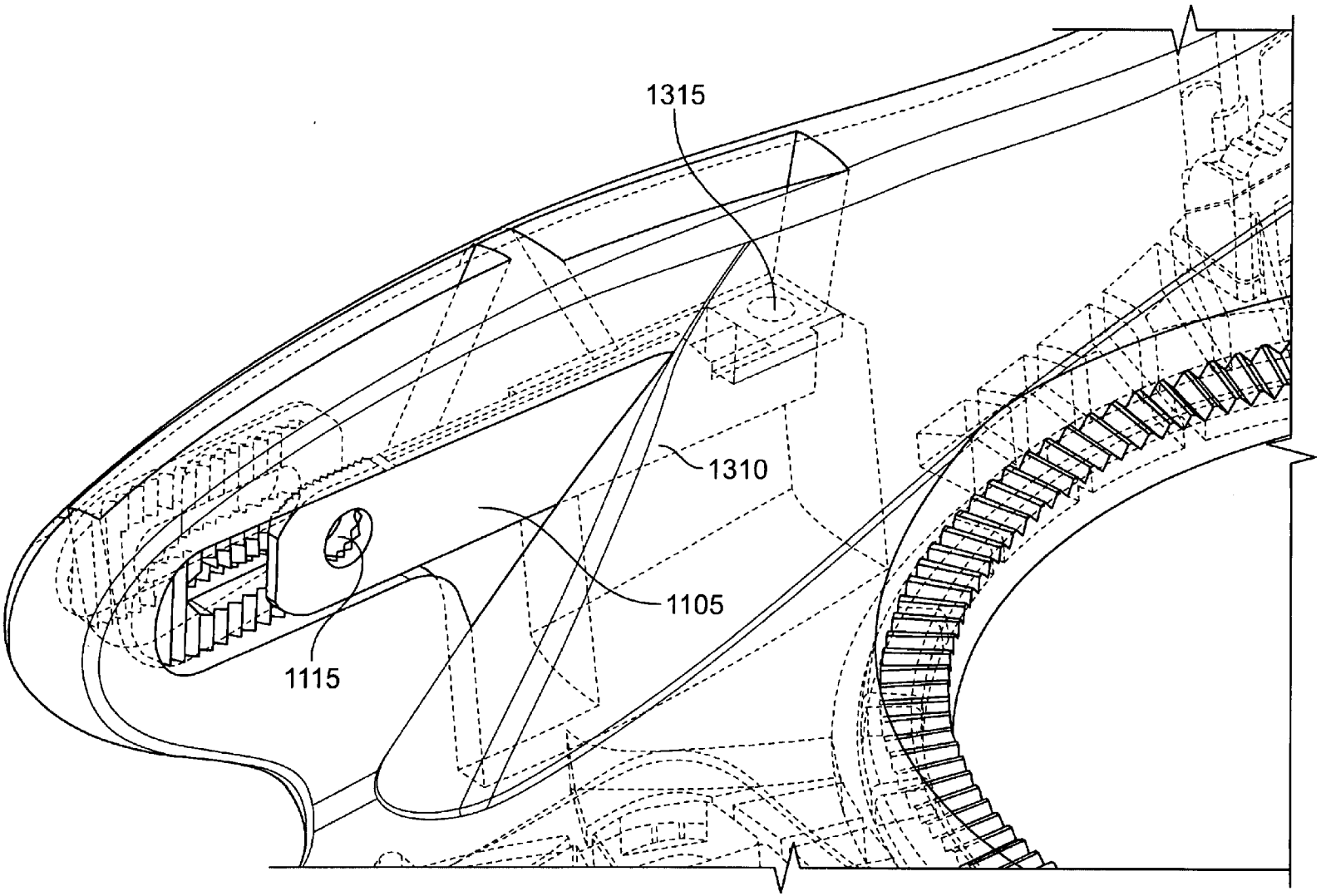
FIG. 13 shows a perspective, partially transparent view of an inner member positioned within the side member of the binding.

FIG. 12 shows a perspective view of the inner member 1105 positioned in the side member 125 of the binding. FIG. 13 shows a perspective, partially transparent view of the inner member 1105 positioned in the side member 125 of the binding. FIG. 11-13 show one side of the binding and it should be appreciated that an opposite side of the binding may or may not have a similar arrangement. As best shown in FIG. 13, the inner member 1105 is slidably positioned inside a cavity in the side member such that the inner member includes a portion 1310 that is positioned internal to the side member 125. The portion 1310 includes an aperture 1315 or other attachment means that serves as an attachment point for connecting to a first end of the connection member 117 thereby forming the secondary attachment location 820 of the triangle 830. The connection member 117 extends downwardly into the side member 120 through an access port 1205 in the upper region of the side member 120 such that the first end of the connection member 117 can be attached to the aperture 1315. As mentioned, the connection member 117 also wraps around or is connected to the highback. The opposite end of the connection member 117 connects to a similar mechanism on the opposite side member 120, or, alternatively, a second connector is located on the opposite side of the binding, connecting the highback to the side member. In this manner, the ends of connection member 117 are fixedly attached to adjustment mechanisms via the inner members 1105 on opposite sides of the binding.

The primary attachment location 155 of the triangle 830 corresponds to the location of the holes 1015 and 1115 of the inner and outer members of the adjustment mechanism. That is, the holes 1015 and 1115 serve as attachment locations for attaching the highback 115 to the adjustment mechanism 1005. As shown in FIG. 6, the highback 115 includes a pair of attachment locations 155 (FIG. 6) that are adapted to couple the highback to the side members 125 of the base plate 105. The attachment locations 155 on the highback are aligned with the holes 1015 and 1115 on each side of the base plate by inserting the highback through an access port 1205 in the upper region of the side member 125. The locking screw is then inserted through the holes to thereby attach the highback 115 to the inner and outer members of the adjustment mechanism. In this manner, the highback 115 is attached to the inner and outer members of the adjustment location at a first location (corresponding to the holes 1015 and 1115, while the connection member 117 is attached to the adjustment mechanism at aperture 1315.

In one embodiment, a lower end of the rear strap 150 of the instep member 110 is also attached to the adjustment mechanism at a third attachment location. The rear strap 150 can attach to the adjustment mechanism, for example, at the same location where the highback 115 is attached. In such a configuration, the third coupling location is at the same location as the primary attachment location. For example, the rear strap 150 can attach to the holes 1015 and 1115 of the inner and outer members of the attachment mechanism. It should be appreciated that the rear strap 150 could attach to other locations of the adjustment mechanism.

In use, the adjustment mechanism shown in FIGS. 10-13 permits the triangle 830 to be moved in a longitudinal direction by unlocking the locking screw that is positioned in the holes 1015 and 1115 of the inner and outer adjustment members. The holes 1015 and 1115 of the inner and outer adjustment members serve as attachment points to the highback (and possibly the rear instep strap 150), while the hole 1315 of the inner member serves as an attachment point for the connection member 117. The highback, connection member, and rear instep strap are thereby fixedly attached to the adjustment mechanism with a fixed relative geometry therebetween.

With the locking screw untightened, the inner and outer members can slide along the side member 125 to vary the position of the triangle 830. As the inner and outer members slide, the attachment points of the highback, rear instep strap, and connector 117 also slide while maintaining the fixed geometry therebetween. The locking screw is then tightened to lockingly sandwich the side member between the inner and outer members and thereby lock the position of the triangle. In this manner, the longitudinal position of the attachment points between the highback/base plate, connector/base plate, and rear instep strap/base plate can be adjusted while maintaining the relative positions between the attachment points. It should be appreciated that the positions of inner and outer members can be swapped such that the inner member is positioned on the outer side of the side member and the outer member is positioned on the inner side of the side member.

Although embodiments of various methods and devices are described herein in detail with reference to certain versions, it should be appreciated that other versions, embodiments, methods of use, and combinations thereof are also possible. Therefore the spirit and scope of the snowboard binding should not be limited to the description of the embodiments contained herein.

What is claimed is:

1. A modular binding for coupling a boot to a sport board, comprising:

a base plate; and a highback connected to the base plate and adapted to provide support to a rear region of a boot, the highback being pivotably attached to a first attachment location relative to the base plate, the highback comprising at least two modular components, each modular component comprising a separate material such that the modular components collectively provide a structural characteristic to the highback wherein the modular components include:

(a) a lower component attached to the base plate; and (b) an upper component attached to the lower component such that the upper component extends upwardly from the lower component in a cantilever fashion, wherein the lower component is attached to the upper component at least one connection location located at an upper region of the lower component and a lower region of the upper component, and wherein the at least one connection location permits the upper component to be moved by a user relative to the lower component such that the user can adjust the position of the upper component relative to the lower component; and a biasing mechanism that is adapted to bias the upper component back toward a default position relative to the lower component after movement of the upper component relative to the lower component wherein the biasing mechanism is a spring; and an elongated cable attached to a second attachment location on the heel support element and to a third attachment location on a region of the base plate forward of the first attachment location such that the first, second, and third attachment locations collectively define a generally triangular shape when viewed from a side of the binding, wherein the cable limits movement of the heel support element relative to the base plate.

2. A binding as in claim 1, wherein the highback includes at least three modular components.

3. A binding as in claim 1, wherein the base plate includes at least two modular components.

4. A binding as in claim 1, wherein materials from which the modular components are constructed are adaptable to adjust the interface characteristics between the binding and a user's boot.

5. A binding as in claim 1, wherein the modular components can move relative to one another to permit the size and shape of the highback to be adjusted.

6. A binding as in claim 1, wherein the lower component is manufactured of a material that is more rigid than the upper component.

7. A binding as in claim 1, wherein the modular components comprise a lower component, a central component, and an upper component, wherein each component can be manufactured of a different material to meet specific performance or cost requirements.

8. A binding as in claim 1, wherein the binding includes an adjustment mechanism that synchronously moves two or more binding fitting elements to various positions.

9. A binding as in claim 1, wherein the upper component can rotate relative to the lower component.

10. A binding as in claim 1, wherein the upper component can be slidably moved relative to the lower component along a vertical axis.

11. A binding as in claim 1, wherein a user can adjust the position of the upper component relative to the lower component in upward-downward or side-to-side directions.

12. A binding as in claim 1, wherein the upper component can move relative to the lower component in response to an external force on the highback.

13. A binding as in claim 5, wherein the modular components are adapted to move from a first relative position to a second relative position during the use of the binding, and wherein the modular components remain in the second relative position after movement.

14. A binding as in claim 5, further comprising a deformable bushing or other insert located at the coupling point between modular components for the purpose of allowing a predetermined range of motion of one modular component with respect to another.

15. A binding as in claim 9, wherein the upper component rotates about the connection location.

16. A binding as in claim 10, wherein the upper component can be slidably moved relative to the lower component along a horizontal axis.

17. A binding as in claim 10, wherein the upper component can be slidably moved relative to the lower component along a horizontal axis and a vertical axis.

* * * * *